United States Patent [19]

Nordstrom

[11] 4,043,285

[45] Aug. 23, 1977

[54] CONTAINER SHIP

[76] Inventor: Immo R. Nordstrom, P.O. Box 305, Fair Haven, N.J. 07701

[21] Appl. No.: 661,140

[22] Filed: Feb. 25, 1976

[51] Int. Cl.[2] ..... B63B 25/22

[52] U.S. Cl. ..... 114/72; 114/83; 214/15 R

[58] Field of Search ..... 114/43.5 VC, 72, 76, 114/83, 260; 214/15 R

[56] References Cited

U.S. PATENT DOCUMENTS

| | | | |
|---|---|---|---|
| 689,821 | 12/1901 | Howland-Sherman | 114/83 |
| 1,485,373 | 3/1924 | Dornier | 114/83 |
| 2,363,797 | 11/1944 | Lovfald | 114/72 |
| 2,743,694 | 5/1956 | McAleer | 114/83 X |
| 2,988,036 | 6/1961 | Mooneyhan et al. | 114/72 |
| 3,437,066 | 4/1969 | Schwendtner | 114/260 |
| 3,552,345 | 1/1971 | Harlander et al. | 114/72 |

*Primary Examiner*—Trygve M. Blix

*Assistant Examiner*—Gregory W. O'Connor

*Attorney, Agent, or Firm*—Roylance, Abrams, Berdo & Kaul

[57] ABSTRACT

A container ship is provided with an upper structure extending aft of the stern and a cargo deck substantially at the waterline. An internal support framework of longitudinal, transverse and upright structural members, interconnected with each other, provides strength and rigidity to the ship. Vertical structural members cooperate with the support framework to define a plurality of cargo compartments. The upper structure serves as a crane support structure and is integral with the hull and extends longitudinally over the cargo compartments and aft of the stern. Travelling bridge cranes are movable along longitudinal rails forming a part of the crane support structure to enable containers to be moved into, out of and between the cargo compartments.

4 Claims, 8 Drawing Figures

FIG. 1
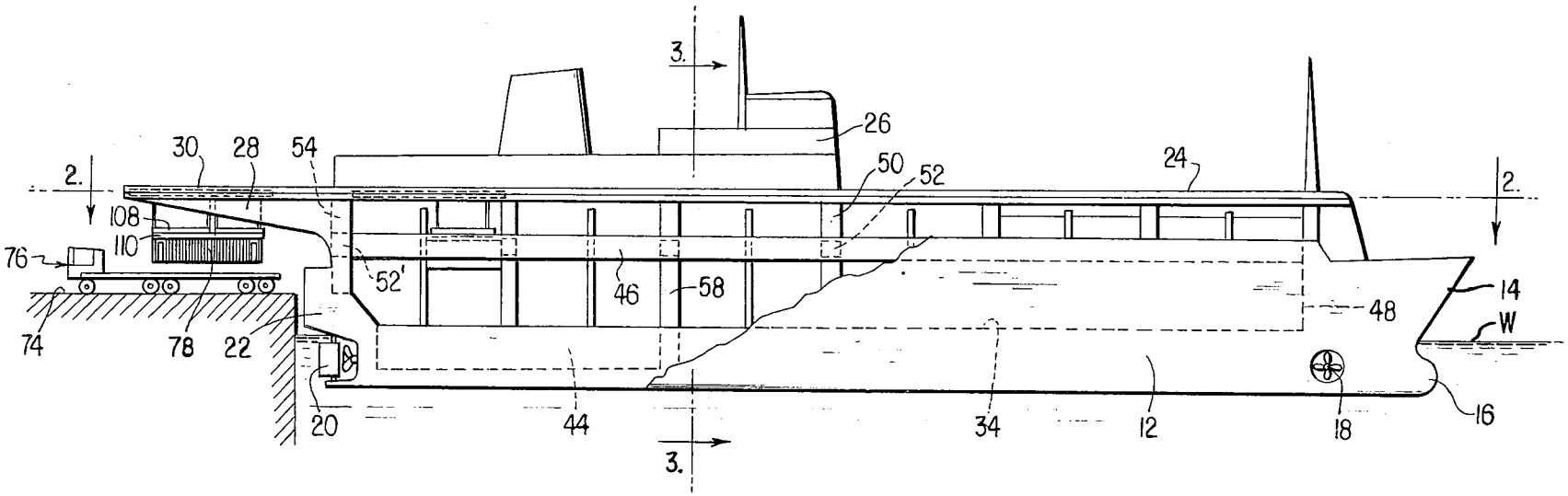
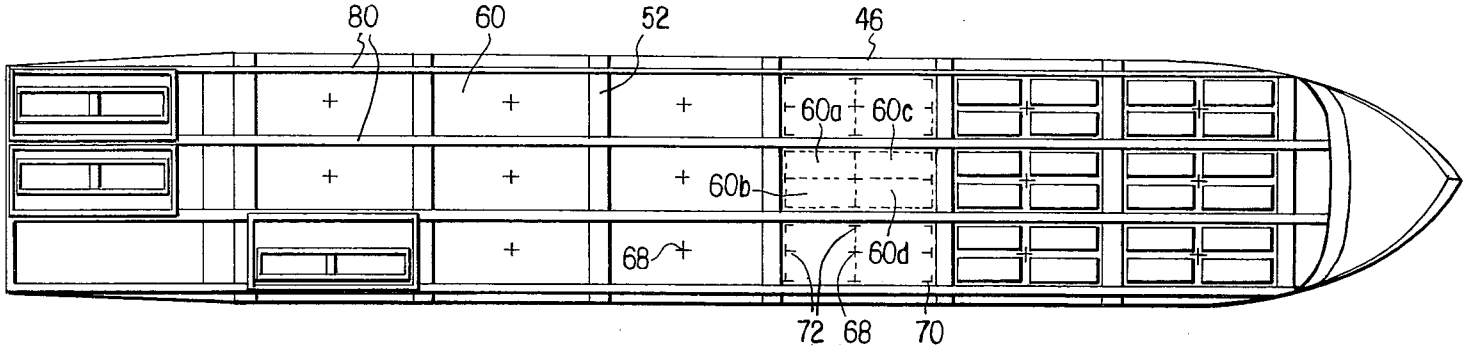
FIG. 2

CONTAINER SHIP

This invention relates to merchant marine vessels and more particularly it relates to a marine vessel of the type adapted for handling and transport of a plurality of standardized containers. Marine vessels of this type are commonly referred to as container ships.

The use of standardized shipping containers has become qyite widespread. Such containers are usually large metallic hollow rectangular units of strandardized size which are capable of being tightly sealed. Such containers are strong enough to withstand stacking one upon the other and the handling and transporting movements to which they are subjected without damaging the contents within the containers. The containers are provided with corner castings by which the containers can be lifted and moved.

While containers of this type can be readily transported over long distances by trucks, airplanes or ships, such a significant number of such containers have been transferred by ships that a whole class of marine vessels, known as container ships, have been developed and designed especially for the handling and transport of such containers. Yet, the known forms of container ships have had certain drawbacks, either in connection with their cost or in connection with their adaptability.

One known form of container ship is that which utilizes hatch covers with open holds beneath the hatch covers into which the containers can be inserted and stacked. In this type of container ship, there is the problem of opening and closing the various hatches to introduce the containers into the holds and to remove them therefrom. Additionally, once the hatches are closed, further containers are stacked upon the hatch covers and upper deck and lashed thereto. Since these containers overlie the hatch covers, these exposed containers must be moved to gain access to the holes. Also, those containers which are exposed on the deck are subjected to damage from heavy seas when they are transported across the oceans.

As to handling of the containers themselves, many known forms of conventional container ships have employed cargo booms which are attached to the ship and extendable over the sides and ends thereof for picking up and discharging of cargo. With normal cargo loads, such booms are acceptable, but with heavy standardized containers, such booms may not be strong enough to lift the weights involved. Also, even if the booms are strong enough to lift the containers, such lifting or lowering is slow and causes the ship to list which could prove damaging to a ship and the containers which are loaded or unloaded.

Many known forms of container ships have entirely dispensed with cargo handling devices on board, and instead, have relied upon the use of port cranes to do the cargo handling. While such an arrangement might be acceptable under certain circumstances, mainly when large quantities of containers are transported, it must be realized that there are many ports which will not have the appropriate forms of equipment. Alternatively, even if such equipment is available, there may be only limited numbers of such port cranes available and a container ship might thus have to wait its turn to use these cranes, thereby wasting valuable time.

In an endeavor to overcome certain of these problems, container ship designers have turned to the use of onboard gantry cranes. These heavy gantry cranes may weigh up to 500 tons or more, and accordingly, the container ships have to be strengthened extensively merely to support the moving weight of these cranes and to withstand the bending and torsional forces which are encountered during their use. Also, such cranes as they extend above the upper deck actually change the effective center of gravity for the ship which is a further factor which must be considered and compensated for in the ship design. Even when such cranes are used, they often employ side pick-up jibs which still make the container ship subject to listing as these jibs are used.

Other known forms of container ships are those known as roll-on/roll-off ships which use a series of sloped ramps which enables cargo to be wheeled onto and off of the ship. Also, it is known to provide a liftable rear platform or gantry crane on the ship to raise and lower floating barges on which the containers or other cargo have been placed. The problem with these approaches, however, is that they are unable to load the barges from a pier, and instead, must load the barges from the water. Also, these ramps, platforms and the like detract from the space which would otherwise be available for storing of cargo.

With the foregoing in mind, it is, therefore, an object of the present invention to overcome the short comings and deficiencies associated with known forms of container ships and to provide in their stead, a new and improved container ship.

Another object of the present invention is to provide a container ship of the self-loading and unloading type wherein cargo in the form of containers can be readily lifted directly from a port dock and deposited directly into the storage holds of the ship.

Another object of the present invention is to provide a container ship wherein all of the cargo and the cargo handling means are disposed internally of the ship.

Another object of the present invention is to provide a container ship which eliminates intermediate decks, ramps, hatch covers, cargo lashings and heavy gantry cranes, and the attendant expense for installation, maintenance and repair of such items.

Another object of the present invention is to provide a container ship which is capable of loading and unloading its cargo at virtually any type of port facility without regard to normal tide conditions or port equipment.

Other objects, advantages and salient features of the present invention will become apparent from the following detailed description, which, taken in conjunction with the annexed drawings, discloses the essential aspects of the invention.

Referring now to the drawings, which form a part of this original disclosure:

FIG. 1 is a side elevational view, partially broken away, of a container ship in accordance with the present invention;

FIG. 2 is a longitudinal sectional view of the container ship taken along the lines 2—2 of FIG. 1.

Figure 3:
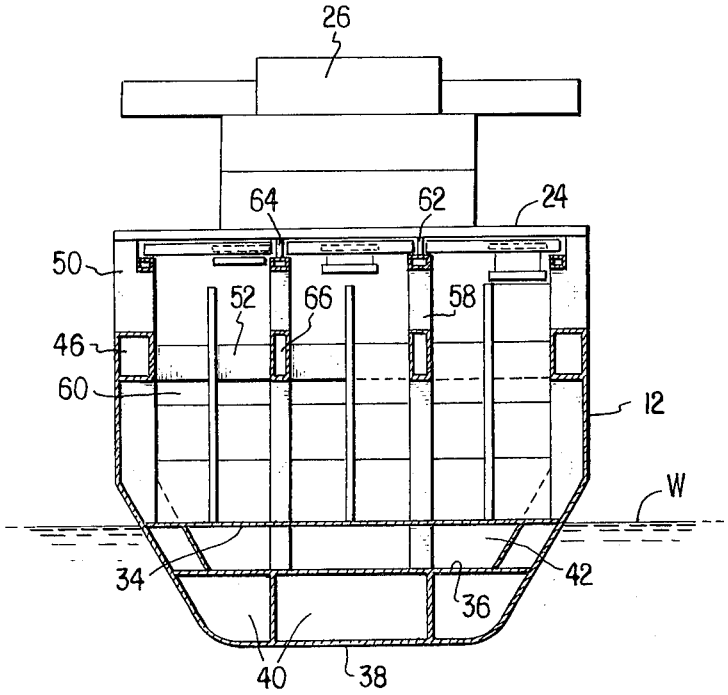
FIG. 3 is a transverse sectional view taken along the lines 3—3 of FIG. 1.

The foregoing objects are attained by providing a container ship having an upper support structure including a rear portion and support means therefor extending aft of the stern of the vessel. With the container ship, a cargo deck is provided in spaced parallel relation beneath the upper support structure and is disposed substantially at the water line of the ship. The ship is provided with an internal support framework which includes a pair of opposed elongated structural members which extend longitudinally along opposite sides of the interior of the ships' hull. These longitudinally extending structural members intersect a series of upright structural members provided at spaced intervals along the interior of the hull and these upright structural members extend across and are interconnected with the longitudinal structural members. A plurality of transverse structural members extend laterally across the interior of the vessel and substantially coplanar alignment with the longitudinal structural members. Each of the transverse structural members is longitudinally aligned with an opposed pair of upright structural members and is interconnected with the longitudinal members at the intersection of the upright members.

Means are provided for internally dividing the ship into a plurality of cargo compartments and such means includes a plurality of vertical structural members extending upwardly from the main cargo deck. These vertical structural members are longitudinally and transversely aligned to define between them a plurality of separate cargo compartments.

A container ship of the present invention is provided with self-contained cargo handling and tansporting means which are particularly adapted for conveying of standardized containers. Such means include longitudinally extending support rails which are provided beneath the upper support structure to thus extend above the various cargo compartments. These support rails also extend under the rearwardly extending portion of the upper deck. Travelling bridge crane means are supported and hence movable upon and along the support rails. Such travelling bridge crane means is longitudinally and transversely movable along and within the ship to enable containers to be transferred into and out of the cargo compartments. Because the bridge crane means is rearwardly movable beyond the stern of the ship, it is thus possible to transfer containers to and from the port facility which might conveniently be a wharf, quay, dock, pier, or floating pontoon or barge. The loading and unloading of the containers will be unaffected by moderate tides and since all loading and unloading is from the stern of the vessel, the ship will not be subjected to any undesirable listing.

In contrast with known forms of container ships, the ship of the subject invention does not need any intermediate decks or ramps and does not employ any heavy and expensive travelling gantry cranes which exert point loads on the hull and greatly increase the structural requirements and hence cost of the ship. Instead, the present invention uses internally contained relatively lightweight travelling bridge cranes supported by support structure integral with the hull.

Referring now to the drawings in greater detail, there is shown in FIGS. 1 and 2, a container ship in accordance with the present invention, such ship being generally designated 10. The ship 10 has an external hull 12 having a bow 14 with a bulbous underwater portion 16 designed for reaching high speeds at sea with minimum resistance. Bow thrusters 18 are provided adjacent the forward end of the hull and steering and propulsion gear 20 are provided at the stern 22 of the ship.

Figure 5:
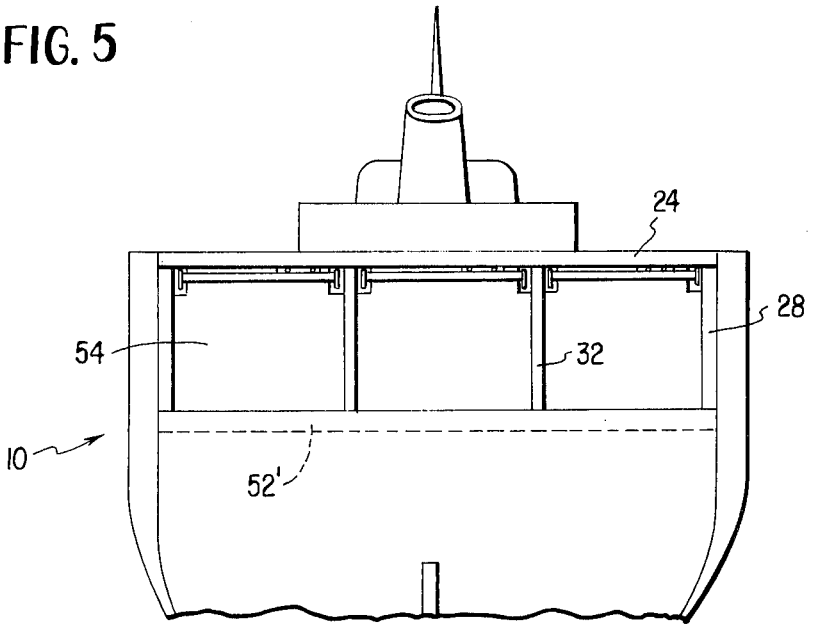
FIG. 5 is a fragmentary rear elevational view of the container ship.

The ship is provided with a horizontal upper structure 24 upon which is mounted the conventional superstructure 26 which provides the crew accomodations and the bridge. This upper structure 24 can be a partial or solid deck or it can be an open structural framework. Rear jibs 28 formed integrally with the hull 12 extend aft or rearwardly of the stern 22 and hence support a rearwardly extending portion 30 of the upper structure 24. As shown in FIG. 5, additional jibs 32 can be provided in spaced relation inwardly from the outer jibs 28, with the jibs 32 forming cantilever support members which are attached to the internal support framework which will be described hereinafter.

A cargo supporting deck 34 is provided within the ship 10 in substantial alignment with the water line of the ship, such water line being designated W in FIG. 1. The cargo supporting deck 34, as can be seen, is disposed in spaced parallel alignment beneath the upper structure 24 of the ship. It is the cargo deck 34 which serves as the bottom of the cargo compartments and which hence serves to support all of the containers placed within the various cargo compartments.

Figure 4:
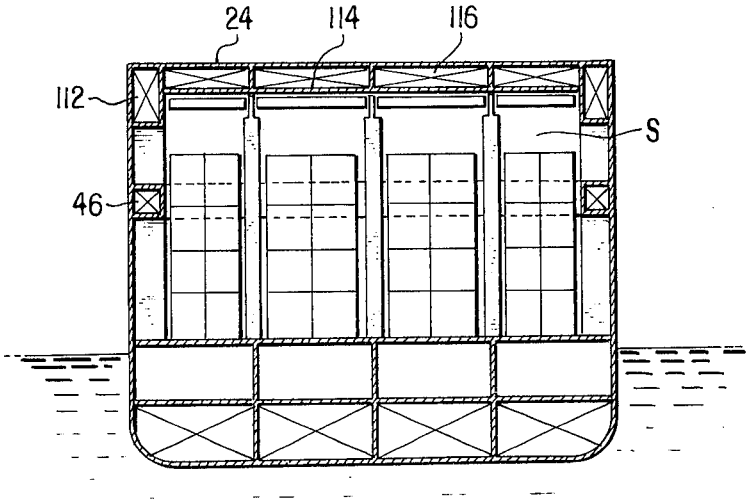
FIG. 4 is a transverse sectional view similar to that of FIG. 3 but showing a modified embodiment of the container ship of the present invention.

If reference is made to FIG. 3 and FIG. 4, there is illustrated beneath the cargo deck 34 a tank top deck 36, and beneath that, the ship's outer bottom 38 which connects with the hull 12. Bottom tanks 40 are formed between the outer bottom and the tank top deck and these bottom tanks are ordinarily filled with water to provide ballast for the ship 10. Cargo holds 42 are formed between the cargo deck 34 and the tank top deck 36 and while these holds 42 are usually empty, they can be filled if desired, to alter the ballast of the ship to increase the stability as desired. As shown in FIG. 1, the ship's engine room 44 is provided beneath the main cargo deck 34. Preferably, that portion of the main cargo deck extending above the engine room 44 is removable so that the travelling overhead bridge cranes which are used for handling and moving the containers in the ship can also be used for lifting the engines or parts thereof for repair, maintenance and reconditioning.

The ship 10 is provided with an internal support framework which includes a plurality of intersecting and interconnected structural members. From the standpoint of weight, strength and cost, it is preferred that these various structural members be in the form of hollow box girders. However, it is also possible for the structural members to be constructed of other structural shapes such as L-beams, T-beams or I-beams. The support framework includes a pair of opposed elongated longitudinal structural members 46 which extend longitudinally along the interior of the hull 12 from the stern 22 of the ship to a forward location 48 which forms the front terminus of the cargo facilities. As shown in FIGS. 1–3, these longitudinal structural members 46 are spaced beneath the upper deck 24 and above the main cargo deck 34, extending in spaced parallel relation to both of such decks and the longitudinal structural members 46. A plurality of upright structural members or web frames 50 extend along the interior of the hull 12 at longitudinally spaced locations therealong. These upright structural members 50, which also advantageously take the form of box girders, thus extend substantially perpendicular to and are interconnected with the longitudinal structural members 46. The lower end of these upright structural members 50 extends to and is supported by either the cargo deck 34 or the tank top deck 36. The upper end of these upright structural members 50 is connected to the upper structure 24.

In addition to the longitudinal structural members 46 and the upright structural members 50, the internal support framework also includes a plurality of transverse structural members 52, also advantageously in the form of box girders. These transverse structural members 52 are aligned in substantially coplanar relation with the longitudinal structural members 46 and are themselves longitudinally spaced to intersect and coincide with the upright structural members 50.

Figure 6:
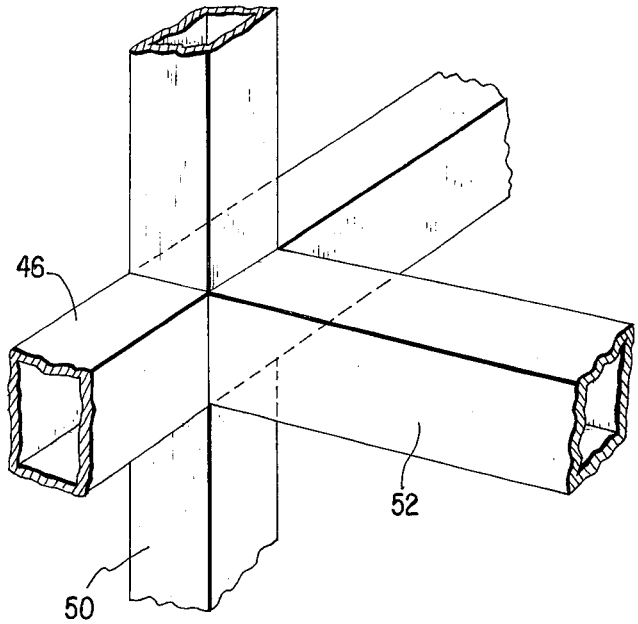
FIG. 6 is a fragmentary prospective view of an internal framework utilized on the container ship of the subject invention.

The interconnection between the longitudinal, upright and transverse structural members is illustrated most clearly in FIG. 6. Each of these structural members is again advantageously formed as a hollow box girder and the interconnection between the respective members is preferably created by welding these members together. The illustrated embodiment of container ship utilizes seven equally longitudinally spaced upright members 50 extending along the opposite sides of the interior of the ship, and accordingly, utilizes seven transverse structural members extending therebetween. The rearmost of the transverse members 52 is designated 52'. An open space 54, as shown in FIG. 5, is provided between the upper deck 24 and the rearmost member 52'. This access opening 54 forms the opening by which the containers can be moved into and out of the ship. As illustrated in FIG. 5, the access opening 54 can itself be longitudinally divided into three separate chambers, by means of the internal jibs 32. If desired, closure doors can be provided for the purpose of closing the access opening 54 during the time that the ship is in transit, although such closure is not generally required since the ship rides high in the water and the access opening is thus disposed considerably above the water line W.

Means are provided in the interior of the ship for internally dividing such ship into a plurality of cargo compartments. Such means includes a plurality of vertical structural members 58 extending vertically upright from the main cargo supporting deck 34, or, if desired, from the tank top deck 36 and upwardly through the main cargo supporting deck 34. These vertical structural members, also preferably in the form of box girders, are longitudinally and transversely aligned with one another to define therebetween a plurality of cargo compartments. Thus, in the embodiment of FIGS. 1—3, two longitudinal rows of vertical structural members 58 are provided, with each structural member within such longitudinal row being aligned with the upright structural member 50 to the outside thereof. An arrangement of this type thus forms a plurality of separate cargo compartments 60 of which eighteen are formed in the FIGS. 1-3 embodiments, as can clearly be seen from FIG. 2. The upper ends of these vertical members 58 are attached to some form of upper support means, which can either be a direct attachment to the underside of the upper structure 24 or an attachment to an auxiliary support member 62 which itself is attached by a connecting member 64 to the underside of the upper structure 24. To further internally strengthen the structure of the ship 10, it is possible to provide auxiliary longitudinal structural members 66, as shown in FIG. 3, to extend between the vertical members 58 substantially at the height of the transverse members 52.

The cargo holds 60 can be divided internally, if desired, to facilitate the stacking of the various containers to be placed therein. Thus, as shown in FIG. 2, cruciform vertical posts 68 are provided centrally within each cargo compartment 60, such posts extending upward from the main cargo deck 34 but terminating at a level beneath the upper structure 24. In addition to these cruciform members 68, angular corner members 70 can be provided at the four corners of each cargo compartment 60 and intermediate members 72 between each set of corner members. The result of such an arrangement, as shown in FIG. 2, is to effectively divide the cargo compartment 60 in which such members are provided into four separate open cargo compartments which are designated 60*a,* 60*b,* 60*c* and 60*d.*

Referring back to FIG. 1, there is illustrated therein a port facility 74 in the form of a quay, dock, wharf or other platform, elevated somewhat above the water level W and over which the rearwardly extending portion 30 of the ship's upper structure 24 projects. As a result, a truck 76 or other transport means can back into the quay 74 for the purpose of positioning thereon one or more of the containers 78. As an alternative, the containers 78 can simply be stacked upon the port facility, either for loading onto the ship 10 or after being unloaded therefrom.

The containers 78 are of standard form and standard size, coming in nominal lengths of 20 or 40 feet, being provided with doors which can be closed and sealed, and have corner castings with sockets therein to permit ready engagement of lifting pins thereinto. The cargo compartments 60, as illustrated in FIG. 2, are designed to receive and retain four of the 20 foot containers 78. That is, one such container can readily fit within the compartment section 60*a,* another within the compartment section 60*b,* and so on. Also, since these containers are readily stackable, the containers themselves can be stacked one upon the other within the compartments or within the sections of the compartments. The various upstanding sectional dividing members 68, 70 and 72 can be removably mounted within sockets in the cargo supporting deck 34 so that the same can be installed or removed, as is necessary for the cargo being stored within particular compartments 60.

Figure 7:
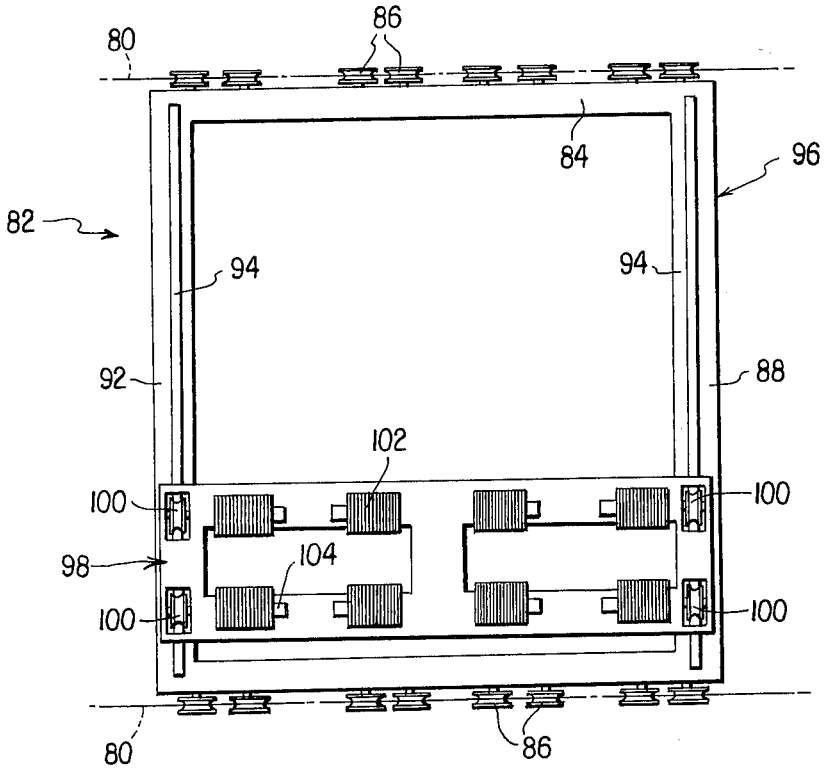
FIG. 7 is a top plan view of the travelling bridge crane utilized in the present invention.
Figure 8:
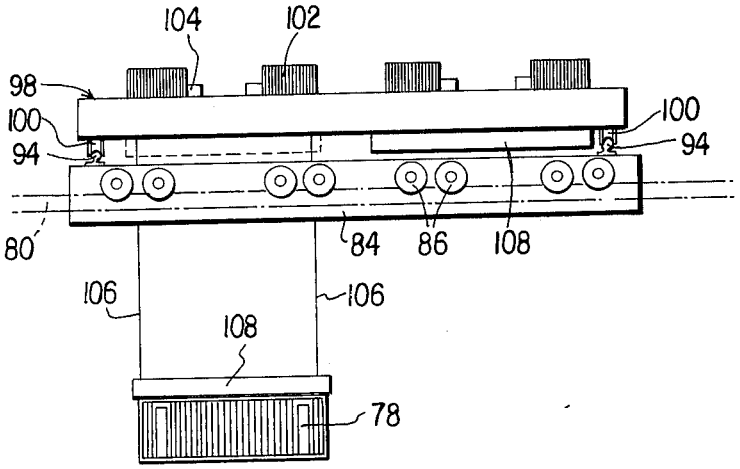
FIG. 8 is a side elevational view of the travelling bridge crane means of FIG. 7.

In order to accomplish the necessary movement of the containers 78, the ship is provided with internally contained cargo handling and transporting means. Such means includes a series of longitudinally extending rails 80 attached in spaced coplanar relation beneath the upper structure 24 and extending beyond the rearmost portion 30 thereof. These rails 80 serve to support and movably mount a series of travelling bridge cranes generally designated 82 and the details of which are illustrated in FIGS. 7 and 8. Each travelling bridge crans 82 includes a longitudinally movable trolley having a pair of side beams 84 upon which rail engaging wheels 86 are mounted. The side beams 84 are connected by a forward beam or member 88 and a rear beam or member 92. These beams 88 and 92 have mounted thereupon transversely extending rails 94. The entire longitudinally movable trolley can be generally designated as 96. Its width transversely is sufficient to assure that the rail engaging wheels 86 will properly engage against and be supported by the longitudinally extending rails 80 which are mounted beneath the ship's upper structure.

The travelling bridge crane means 82 further includes a transversely movable trolley generally designated 98, mounted to and hence movable across the longitudinal trolley 96. The transverse trolley 98 includes a plurality of rail engaging wheels 100 which abut agaist and hence move the trolley across the transverse rails 94. The transversely movable trolley carries thereon a plurality of lifting or hoisting wire drums, which, in the illustrated form, are eight in number. Each of these wire drums 102 is connected with and controlled by an operating motor 104 which rotates the wire drums so that the wire thereon is either raised or lowered, as desired. The wire or cable attached to each of these wire drums is designated 106. If desired, the longitudinally movable trolley 96 can be referred to as the bridge crane while the transversely movable trolley 98 can be referred to as the hoisting trolley. The controls for movement of these trolleys and for winding and unwinding of the wire drums 102 by the motors 104 can be accomplished by a cab mounted on the trolleys or by means of hanging control cables or by automatic computer control means or any other known type of control system for movement of trolleys of this type.

The particular size and configuration of the trolleys 96, 98 is selected to permit simultaneous handling of two 20 foot containers 78, arranged with two such containers longitudinally extending end to end. Alternatively, the cranes can handle one 40 foot container 78. The lifting and lowering of these containers is accomplished by means of spreader frames 108 which are supported at their four corners by the wires or cables 106 from the wire drums 102. These spreader frames are themselves provided with locking pins, often called twist locks, which engage into and lock within the corner castings on the containers 78. As a result, as shown in FIG. 8, when a spreader frame 108 is lowered onto the top of a container 78, and the locking pins are locked into the container's corner castings, the containers can then be raised by means of the four lifting cables 106 which extend generally above the corners on the lifting frame 108. In use, the container 78 is lifted until the spreader frame 108 is substantially raised to the level of the trolley. Then, the longitudinally movable trolley 96 is moved forwardly along its supporting rails until the container is disposed above the particular cargo compartment 60 into which it is to be inserted. The cables are then lowered so that the spreader frame and container drop downwardly to rest either upon the cargo supporting deck 34, if the compartment happens to be empty, or upon the top of the containers already disposed therein. The frame 108 is then released from the container, raised back up and the trolley and crane is hence moved rearwardly again to pick up another container.

If a 40 foot container is to be raised, instead of a 20 foot one, then two spreader frame 108 are lowered into engagement with an auxiliary elongated spreader frame 110, as shown in FIG. 1, and this spreader frame 110 in turn is connected to the elongated container 78.

It will thus be understood that the travelling overhead cranes 82 form transporting devices, disposed internally of the ship, which can be used to move containers into and out of the ship through the rear access opening 54. These same cranes can be used to transversely and longitudinally move the containers within the ship, if it should prove necessary to move a container from one compartment to another, and can also be used for raising and lowering equipment in the ship's engine room 44, by removing the overlying section of the main cargo deck 34 in the manner previously described. One such crane means 82 is provided between each longitudinally extending set of rails, which means that in the embodiment of FIGS. 1–3, three such cranes are provided. In the alternative arrangement of FIG. 4, four longitudinally extending passages are provided, and as a result, four cranes must be provided. Overhead cranes of the type designated 82 are highly effective and are capable of easily raising and lowering the otherwise moving the container 78, yet each such crane means weighs only about 30 tons or so per container, or 60 to 70 tons total. In contrast, the gantry cranes which were used in prior art forms of container ships weighed approximately 500 tons, thus requiring that the ship structure itself be materially strengthened if only to support the weight of the crane.

There is no limitation on the number of longitudinal structural members which are utilized in the subject invention. For example, in the FIG. 4 embodiment, upper longitudinally extending structural members 112 are provided in spaced relation above the usual members 46. Also, the upper structure 24 in FIG. 4 is strengthened by providing another deck 114 or lower flanges of structural girders in spaced relation therebeneath. The container ship FIG. 4 is illustrated in fully loaded condition, yet it will be seen that a space designated S is provided above the uppermost of each of the containers and the crane means 82 mounted therewithin.

This space S is obviously necessary to permit the crane at any time to lift a container out of its particular cargo compartment, upwardly into the space S, and to thereafter longitudinally move such container through the space S and through the access opening 54 at the rear of the ship to discharge the container at a port facility.

Various changes and modifications apparent to those skilled in the art may be made without departing from the spirit and scope of the invention as defined in the appended claims.

What is claimed is:

1. A marine vessel adapted for handling and transport of a plurality of containers, said vessel comprising:

A. an external hull;

b. a horizontal upper structure extending across said hull;

c. upper structure support means extending rearwardly of said hull;

d. said upper structure being supported by said support means and hence extending rearwardly of said hull;

e. a cargo supporting deck disposed within said hull in substantial alignment with the waterline of said vessel;

f. an internal support framework comprising:

a pair of opposed longitudinal structural members extending longitudinally along the interior of said hull;

said longitudinal structural members being disposed below said upper structure and above said cargo supporting deck and in parallel relation to said deck;

a plurality of upright structural members extending along the interior of said hull at longitudinally spaced locations therealong, said upright structural members being interconnected with said longitudinal structural members; and a plurality of transverse structural members extending transversely across the interior of said hull, said transverse structural members being substantially coplanar with said longitudinal structural members;

each of said transverse structural members being longitudinally aligned with an opposed pair of upright structural members and being interconnected with said longitudinal structural members;

g. means for internally dividing said vessel into a plurality of cargo compartments, said means comprising:

a plurality of vertical structural members extending upwardly from said cargo supporting deck; and upper support means to which said vertical structural members are attached;

said upper support means being connected with said upper structure support means;

said vertical structural members being longitudinally and transversely aligned to define therebetween a plurality of cargo compartments;

h. container handling and transporting means comprising:

access opening means at the stern of the vessel;

said access opening means comprising an enlarged access opening extending between the underside of said upper structure and the rearmost of said transverse structural members;

a plurality of spaced parallel longitudinally extending support rails disposed beneath and attached to said upper structure;

said support rails extending from substantially the forward end of the cargo compartments, through said enlarged access opening and substantially to the rear end of said upper structure;

said longitudinal support rails forming at least two sets of crane rails arranged side-by-side and extending longitudinally above and across said cargo compartments;

a travelling bridge crane means supported upon and movable along each of said sets of crane rails;

said travelling bridge crane means comprising a first trolley means movable longitudinally through said vessel along said support rails and a second trolley means coupled with and movable transversely across said first trolley means;

said second trolley means including hoisting cables adapted for attachment to containers and controllable winding drums for raising and lowering said hoisting cables and containers attached thereto;

each of said travelling bridge crane means being adapted to transfer containers into and out of said cargo compartments by use of said first trolley means to accomplish longitudinal movement of said containers and by use of said second trolley means to accomplish transverse movement and raising and lowering of said containers.

2. A vessel as defined in claim 1 wherein each separate travelling bridge crane means is movable independently of the other travelling bridge crane means.

3. A vessel as defined in claim 1 wherein said structural members are box girders.

4. A vessel as defined in claim 1 further including upstanding divider means in each of said cargo compartments.

* * * * *